United States Patent [19]
Croyle

[11] Patent Number: 4,474,481
[45] Date of Patent: Oct. 2, 1984

[54] GRANULE FLOW TIMER

[76] Inventor: Ronald A. Croyle, R.D. #1 - Helm Rd., Adrian, Pa. 16210

[21] Appl. No.: 357,994

[22] Filed: Mar. 15, 1982

[51] Int. Cl.³ ..... G04F 1/04
[52] U.S. Cl. ..... 368/93
[58] Field of Search ..... 368/93–95

[56] References Cited

U.S. PATENT DOCUMENTS 3,707,842 1/1973 Spivak ..... 368/94

*Primary Examiner*—Vit W. Miska
*Attorney, Agent, or Firm*—Harold A. Williamson

[57] ABSTRACT

A preselected lapsed time indicating granule flow timer. The timer includes in combination first and second enclosed chambers integrally connected by a neck with an opening therethrough to thereby provide communication of an electrically conductive granular material between the first and second chambers dependent upon the physical position of the first and second chambers in respect of each other. The first and second chambers each have an electrically conductive plate integral with an end of each chamber at an end of the chamber remote from the neck that separates the chambers.

Each of the chambers have positioned on a wall of the respective chamber at a point between the electrically conductive plates at least one electrical contact element.

A source of electrical energy in conjunction with a switching arrangement is simultaneously electrically connectable to either of the electrically conductive plates and the electric contact element of one of the chambers, dependent upon the physical position of the first and second chambers.

8 Claims, 3 Drawing Figures

GRANULE FLOW TIMER

TECHNICAL FIELD

This invention relates to a preselected lapse time indicating granule flow timer.

BACKGROUND ART

Among the earliest devices fashioned by man to measure the passage of time is that commonly known as the hour glass or sandglass timer. From earliest recorded history these hour glass timers have characteristically included a pair of chambers connected by a necked opening between the chambers to allow the passage of granules from one chamber to the next whenever the timer was inverted. For centuries these timers have been employed whenever a relatively brief passage of time was sought to be measured, and the user of the timer was free to watch the passage of the last granule from one chamber to the other herald the passage of time for which the timer was designed. The parameters of design for this type of timer are relatively simple and include such factors as the size and nature of the granule passing through the opening; the size of the opening and finally, the nature of the cross-sectional opening between the chambers. In all cases known, each span of time sought to be measured required an individually designed timer. Until recently, granule timers of the type being described here required that the user of the timer note visually the passage of the last granule in order to determine the moment the passage of time sought to be measured had lapsed.

The only known sandglass that provides a visual external indication of the passage of time is that patented by David Spivak in U.S. Pat. No. 3,707,842, in which Spivak provides what he terms as an electric signal sandglass. The Spivak electric signal sandglass is shown in the two embodiments of FIG. 1 and FIG. 2. In the FIG. 1 embodiment the classic sandglass described earlier is equiped with a pair of electrically conductive caps 18, 19 which slide on a guide 17 between two positions. The sandglass has a pair of chambers 12 and 13 which include respectively pairs of electrodes 24, 25 and 29, 30, which electrodes are electrical switch contacts for an indication circuit remote from the timer. Whenever the sandglass is inverted, one of the caps 18, 19 rides on the sand granules captured in the chambers 12 and 13 between the caps 18, 19 until the sand 16 has passed through the opening 15 in the neck 14, and the cap then completes the indication circuit noted above. In FIG. 2 of Spivak, a pair of balls 46, 47 carried on a guide 17 fulfills the same function as the caps 18, 19 described in respect of FIG. 1.

The invention to be described more fully hereinafter distinguishes of Spivak in that the granules in the timer are electrically conductive and further the timer is capable of providing a number of preselected time measurements and independently signal the passage of the preselected time.

The subject invention to be described would have particular utility in a timer in my now issued U.S. Pat. No. 4,326,709, Ser. No. 06/101,777, titled Fishing for Cards Game where the players taking turns have their playing time controlled by a simple and inexpensive timer that requires a number of different elapsed times be offered to each player depending upon the skill of the player.

DISCLOSURE OF INVENTION

To be more specific, this invention relates to a preselected lapsed time indicating granule flow timer. The timer includes in combination first and second enclosed chambers integrally connected by a neck with an opening therethrough to thereby provide communication of an electrically conductive granular material between the first and second chambers dependent upon the physical position of the first and second chambers in respect of each other. The first and second chambers each have an electrically conductive plate integral with an end of each chamber at an end of the chamber remote from the neck that separates the chambers.

Each of the chambers have positioned on a wall of the respective chamber at a point between the electrically conductive plates at least one electrical contact element.

A souce of electrical energy in conjunction with a switching arrangement is simultaneously electrically connectable to either of the electrically conductive plates and the electric contact element of one of the chambers, dependent upon the physical position of the first and second chambers.

Visual and/or audible indication units are electrically coupled through a time indication circuit that includes a source of electrical energy, the switching arrangement and the granules between the electrically conductive plate and the electrical contact element to thereby cause an indication of lapsed time that is a measure of the time taken for the electrically conductive granular material to have moved from one chamber to the other.

It is therefore a primary object of this invention to provide a granule flow timer that utilizes an electrically conductive granule material to complete an indication circuit.

Another object of the invention is to provide a granule flow timer that can be set to provide an indication of more than one preselected time interval.

Yet another object of the invention is to provide an electric granule flow timer and indication circuit that can be set to provide more than one preselected time interval, as well as an audible indication of the passage of the time interval.

In the attainment of the foregoing objects, the invention contemplates in its preferred embodiment a granule flow timer that includes first and second enclosed chambers integrally connected by a neck with an opening therethrough to thereby allow electrically conductive granular material to move between the first and second chambers dependent upon the physical position of the first and second chambers in respect of each other. Integrally connected to the first and second chamber is a support secured for rotation about a horizontal axis in an opening in a vertically disposed member secured to a horizontally disposed base.

The first and second chambers include a plurality of electrical contacts on the wall of each chamber. The chambers each have an electrically conductive plate integral with an end of each chamber at an end of the chamber remote from the neck. Each of the electrical contacts in a given chamber are spaced from the electrically conductive plate by a different distance representative of a different time interval. The spacial relationship of the contacts in respect of the electrically conductive plate will be explained in more detail hereinafter.

A resilient electrical base contact is secured to the base and a resilient time selection electrical contact is secured to the vertically disposed member. The resilient time selection electrical contact projects horizontally such that rotation of the integrally connected first and second chambers about the support horizontal axis causes the electrically conductive plate and the electrical contact of the chamber wall of each of the chambers to come consecutively into simultaneous electrical contact with both the resilient electrical base contact and the resilient time selection electrical contact. A switch blade is pivotably secured to the vertically disposed member and is normally moveable into electrical contact with the resilient electrical contact secured to the vertically disposed member. A source of electrical energy is serially connected to the resilient electrical base contact and to an indication unit which is electrically connected in series with the source of energy and the normally moveable switch blade to thereby effect a complete time indication circuit through the indication unit whenever the switch blade is in electrical contact with the resilient time selection electrical contact and the electrically conductive granules have completed a circuit between the electrically conductive plate and one of the chamber wall electrical contacts. This just described circuit when completed will provide an audible or illuminated indication of lapsed time that is a measure of the time taken for the electrically conductive granular material to have moved from one chamber to the other.

Other objects and advantages of the present invention will be apparent upon reference to the accompanying description taken in conjunction with the following drawings.

BEST MODE FOR CARRYING OUT THE INVENTION

Figure 1:
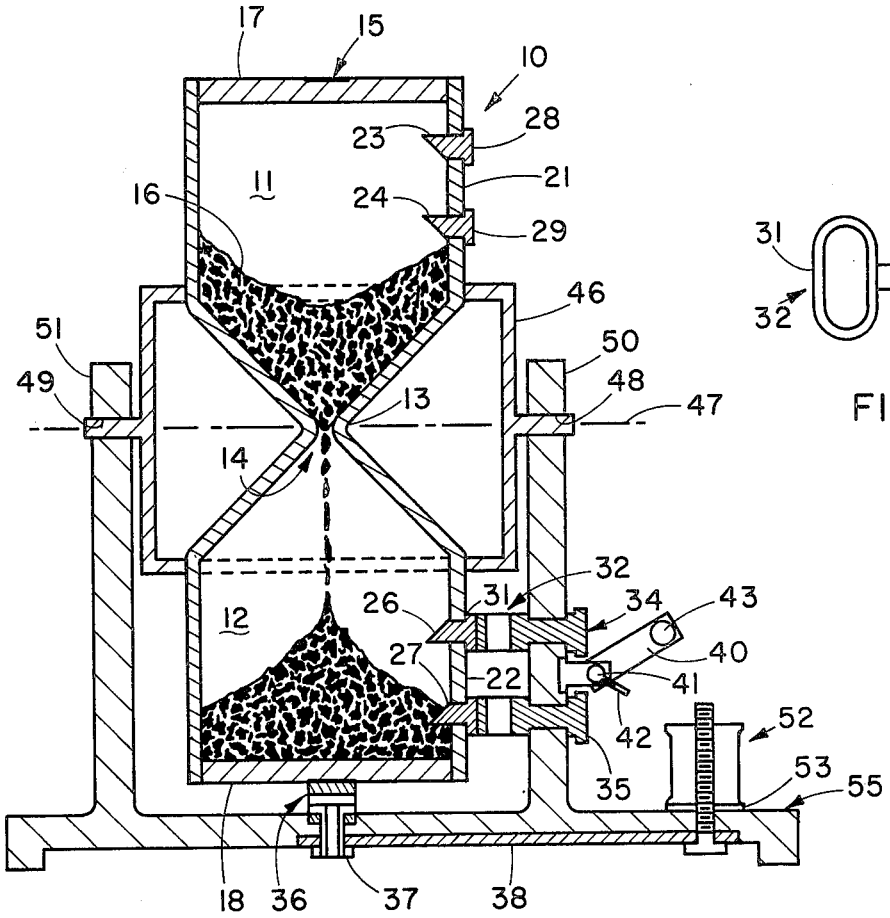
FIG. 1 illustrates a cross-section of the preferred embodiment of the invention.

Reference is now made to FIG. 1 which illustrates the preselected lapse time indicating granule flow timer 10 embodying the invention. The timer 10 includes a first chamber 11 and second chamber 12 which chambers are cylindrical in cross-section and enclosed as shown. The chambers 11 and 12 are integrally connected by a neck 13 which has an opening 14 that allows an electrically conductive granular material 16 to pass through the opening 14 as is dynamically illustrated in FIG. 1. The granular material may be alumina, 325 mesh size. It is believed to be apparent that when all of the granular material 16 has passed from the chamber 11 into the chamber 12, the cycle may be repeated by inverting the integrally connected chambers 11, 12 and allowing the granular material 16 to then pass from the chamber 12 into the chamber 11. The chambers 11 and 12 may be fashioned of glass or any suitable non-conductive material. In fact, the material selected need not be transparent as would be the case if glass were employed. It is contemplated that non-transparent material may be employed without affecting the utility of the invention.

Integrally secured to the chambers 11 and 12 is a support 46 which may be formed of plastic. The support 46 is supported for rotation, as shown, in openings 48, 49 of vertically disposed members 50, 51. The members 50, 51 are integrally formed with a horizontally disposed base 55. This just described arrangement allows the chambers 11 and 12 to rotate about the horizontal axis 47 in a manner that will allow a timing cycle to be repeated.

The chambers 11 and 12 include a plurality of electrical contacts 23, 24 and 26, 27 which pass through the walls 21 and 22 respectively of the chambers 11 and 12. The function of the electrical contacts 23, 24, 26, 27 will be explained hereinafter. The chamber 11 has an end thereof remote from the opening 14, enclosed by electrically conductive plate 17, and the chamber 12 has an electrically conductive plate 18 similarly positioned. Each of plates 17, 18 has a depression such as 15 identified in respect of plate 17. The depression 15 of plate 17 and the unreferenced depression of plate 18 are intended to cooperate with resilient electrical base contact element 36, and by such cooperation form a resilient detent. Each of the electrical contacts 23, 24 and 26, 27 are spaced from the respective electrically conductive plates 17 and 18 by a distance representative of a different time interval.

Figure 2:
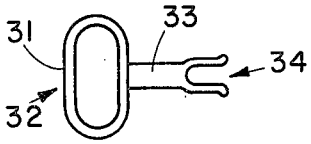
FIG. 2 depicts a top view of a resilient time selection electrical contact element of FIG. 1.

The vertically disposed member 50 has shown passing therethrough resilient time selection electrical contact elements 30, 32, the details of which are better understood by a study of FIG. 2. FIG. 2 is a top view of the resilient time selection electrical contact element 32, with vertical member 50 shown removed. The element 32 has a resilient contact surface 31 secured to a connector stub 33 which terminates with a bifurcated blade receiving contact 34. It will be observed that electrical contacts 23, 24 each have electrical contact surfaces 28, 29 which are intended to come into sliding contact with resilient time selection electrical contact elements 30, 32 as is illustrated in respect of the electrical contacts 26, 27 and the unreferenced electrical contact surfaces thereof.

The time selection electrical contacts 30 and 32 project horizontally as shown, such that rotation of the integrally connected first and second chambers 11 and 12 about the support horizontal axis 47 causes either the electrically conductive plate 17 or 18, and electrical contacts 23, 24 or 26, 27 to come consecutively into simultaneous electrical contact with both the resilient electrical base contact 36 and both of the resilient time selection electrical contacts 30, 32.

A switch blade 40 is pivotally secured by pivot connection 41 in pivot support 45. The pivot support 45 is secured by any suitable and conventional means to the vertically disposed member 50 in the position as shown. The blade 40 has secured thereto a ball shaped knob 43 which may be manually manipulated so as to cause the blade 40 to engage either of bifurcated blade receiving contacts 34, 35. An electrical lead 42 is shown secured to the pivot connection 41.

The resilient electrical base contact element 36 which is configured similar to the resilient contact 31 of FIG. 2, is secured to the base 55 by a metal rivet 37. An electrical lead 38 connects the rivet 37 with the terminal 52 which terminal 52 has an electrical lead 53 shown secured thereto.

Figure 3:
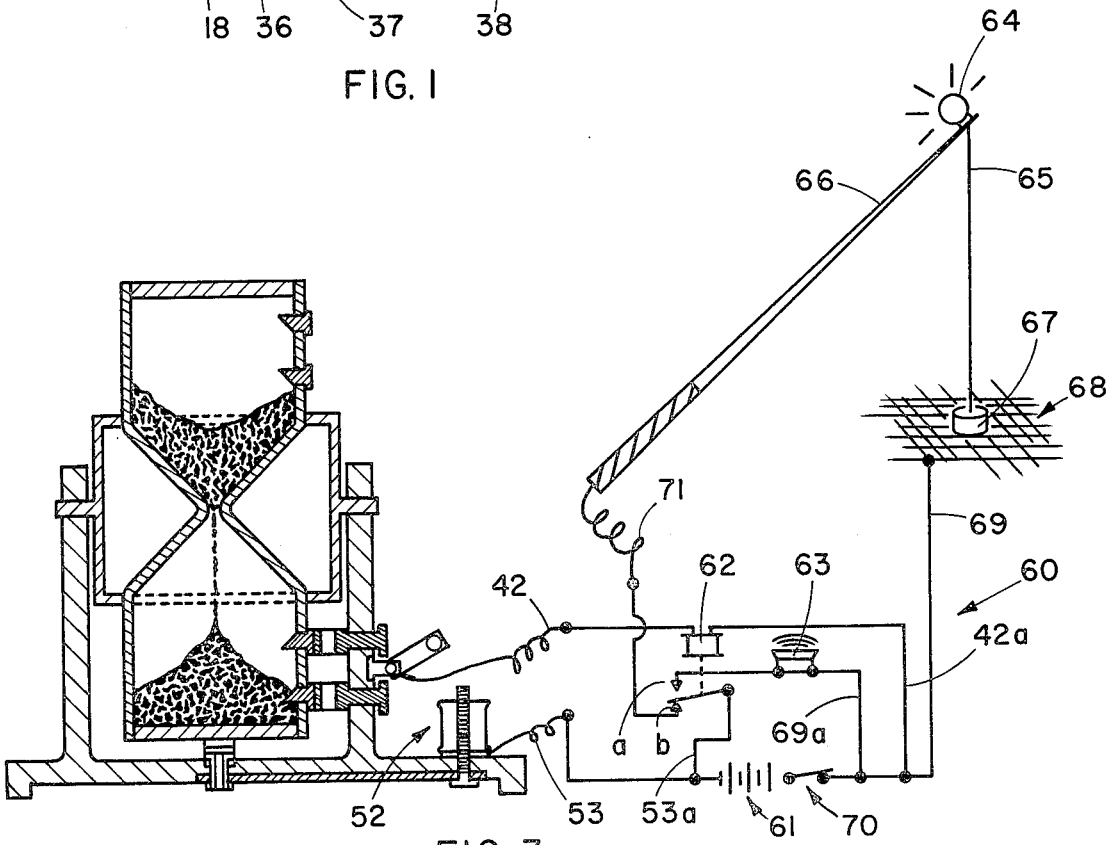
FIG. 3 is a schematic showing of the preferred embodiment of the invention shown in combination with an indication circuit.

Reference is now made to FIG. 3 which illustrates the lapsed time granule flow timer 10 in combination with an indication circuit 60. Attention is first directed to the timer 10 with specific attention called to the electrically conductive plate 18, the electrically conductive granular material 16, and the electrical contacts 26, 27. In FIGS. 1 and 2 the electrically conductive material 16 is shown partially filling the chamber 12. The electrically conductive granular material 16 is shown covering the plate 18, as well as a portion of the electric contact 27. As shown, the electrically conductive granular material 16 will provide an electrical path between the plate and the contact 27 thereby completing an electrical circuit therebetween. The electrically conductive granular material functions as a switch contact between the plate 18 and the contacts 27 and 26. The location of the electrical contacts 26, 27 on the wall 22 will determine the different lapsed time periods that can be provided by the invention. Hypothetically speaking, the electrical contact 27 might represent 30 seconds and the electrical contact 26 might represent 60 seconds. The position, i.e., the distance of the electrical contacts 26, 27 from the plate 18 is a matter of design, and the distance will control or predetermine the lapsed time to be indicated. In FIG. 3, the blade switch 40 is shown in dotted outline and is designated as 40'. It should be apparent that until the electrically conductive granular material 16 flowing from chamber 11 into chamber 12 fills chamber 12 to a point where electrical contact 26 is covered, there will be an open circuit condition between the plate 18 and the electrical contact 26. When electrically conductive granular material 16 covers the electrical contact 26, a circuit will then be completed between the electrical leads 42 and 53.

The indication circuit 60 includes the following basic components: a battery or source of energy 61; a lapsed time relay 62 having front and back contacts a and b, respectively; a horn or audible indicator 63; a light bulb or visual indicator 64; a fishing rod 66; a magnet 67; electrically conductive screen 68 and an indication circuit ON-OFF switch 70, all of which components are interconnected as shown.

One of the environments in which the invention to be described finds particular utility is that described in my copending patent application Ser. No. 06/101,777, now issued U.S. Pat. No. 4,326,709. It should be understood, though not shown in FIG. 3, that the electrical lead 71 passes through the fishing rod 66 to and through the filament of light bulb 64, electrical lead 65 to magnet 67 which magnet 67 makes electrical contact with electrically conductive screen 68 and lead 69 secured to the screen 68. One of the objects of the game more fully described in the above noted patent is to normally drag the magnet across the surface of the screen 68 in order to attract magnetizable playing cards (not shown) that are beneath the screen. Should the player of the game move the magnet 67 to fast and cause the same to break electrical contact with the surface of the screen 68, this fact is to be signaled by the light 64 going off. Each player of the game is given a specified amount of time determined by the position of the blade 40 to operate the fishing rod 66 and magnet 67 to locate the unseen magnetizable cards and draw them to an opening 72. At the end of the preselected lapsed time, an audible alarm will be sounded and the light bulb 64 will be turned off thereby indicating the end of a players turn.

The indication circuit 60 operates in the following fashion. With the indication circuit ON-OFF switch 70 closed, and the magnet 67 in electrical contact with the screen 68, and electrically conductive granular material 16 in the dynamic condition shown, the following circuit will be completed through the light bulb 64: the circuit will include one side of the battery 61, lead 53*a*, back contact b of lapsed time relay 62, lead 71, the filament of light bulb 64, lead 65, magnet 67, screen 68, lead 69, the switch 70 and finally the other side of the battery 61. The bulb 64 will remain illuminated unless and until the circuit is interrupted by the magnet 67 being lifted from the surface of the screen 68 or the end of the lapsed time.

The end of the lapsed time is indicated when the material 16 fills the chamber 12 to a point where a circuit is completed between the plate 18 and the electrical contact 26. The completion of the just noted circuit between plate 18 and contact 26 causes an audible alarm and the turning off of the light bulb 64. The electrical connection of the plate 18 with the contact 26 causes the following circuit that includes lapsed time relay 62 to be actuated. This circuit includes one side of the battery 61, lead 53, lead 38, resilient base contact 36, plate 18, electrically conductive material 16, contact 26, resilient time selection electrical contact element 32, blade 40', lead 42, relay 62, lead 42*a*, closed switch 70 and the other side of battery 61. The energization of relay 62 interrupts the first described circuit that caused the light bulb 64 to become initially illuminated. This occurs because the back contact b of relay 62 is opened when front contact a of relay 62 is closed. The closing of front contact a of relay 62 brings about the completion of the following circuit through horn or audible alarm 63: this circuit can be traced from one side of the battery 61, lead 53*a*, front control a of relay 62, horn 63, lead 42*a*, closed switch 70 to the other side of battery 61.

Although the invention has been illustrated and described in an embodiment that is illustrated with only two preselected time intervals described, it should be understood that additional electrical contacts in the walls of the chambers could be added with accompanying switch or switches. It should also be recognized that any of a number of different electrically conductive materials other than the aluminum powder noted may be employed. Accordingly, it will be apparent to those skilled in the art that various changes may be made therein without departing fron the spirit of the invention as set forth in the appended claims.

I claim:

1. A preselected lapsed time indicating granule flow timer, comprising in combination first and second enclosed chambers integrally connected by a neck with an opening therethrough to thereby provide communication of an electrically conductive granular material between said first and said second chambers dependent upon the physical position of said first and second chambers in respect of each other, said first and said second chambers each having an electrically conductive means integral with an end of each chamber at an end of said chamber remote from said neck, each of said chambers having positioned on a wall of said chamber at a point between said electrically conductive means at least one electrical contact means, a source of electrical energy and means simultaneously electrically connectable to either of said electrically conductive means and said electric contact means of one of said chambers dependent upon the physical position of said first and second chambers, indication means electrically coupled through a time indication circuit that includes said source of electrical energy, said electrically connectable means and said electrically conductive granules between said electrically conductive means and said electrical contact means to thereby cause an indication of lapsed time that is a measure of the time taken for said electrically conductive material to have moved from one chamber to the other.

2. The granule flow timer of claim 1 wherein each of said chambers includes a plurality of electrical contact means on said chamber wall, each spaced from said electrically conductive means by a different distance.

3. The granule flow timer of claim 2 wherein there is provided in combination with said integrally connected first and second chamber a support means secured for rotation about a horizontal axis in an opening in a vertically disposed member secured to a horizontally disposed base means.

4. The granule flow timer of claim 3 wherein there is provided a resilient electrical base contact secured to said base means, a resilient time selection electrical contact means is secured to said vertically disposed member and projects horizontally such that rotation of said integrally connected first and second chambers about said support means horizontal axis causes said electrically conductive means and said electrical contact means in said wall of each of said chambers to come consecutively into simultaneous electrical contact with both said resilient electrical base contact means and said resilient time selection electrical contact means.

5. The granule flow timer of claim 4 wherein there is provided switch blade pivotably secured to said vertically disposed member and manually moveable into electrical contact with said resilient electrical contact means secured to said vertically disposed member.

6. The granule flow timer of claim 5 wherein said indication means is electrically connected in series with said electrical energy source and said resilient electrical base contact means to said manually moveable switch blade to thereby effect a complete time indication circuit through said indication means whenever said switch blade is in electrical contact with said resilient time selection electrical contact means.

7. The granule flow timer of claim 6 wherein each of said electrically conductive means includes a surface depression that cooperates with said resilient electrical base contact means to form a detent to thereby secure said integrally secured first and second chambers in a vertical position with said resilient time selection electrical contact means in electrical connection with said electrical contact means of one of said chambers.

8. The granule flow timer of claim 7 where said electrical contact means positioned on the wall of each of said chambers has a portion thereof passing through the wall to thereby provide said electrical connection with said resilient time selection electrical contact means.

* * * * *